US006431917B1

(12) United States Patent
Belopolsky et al.

(10) Patent No.: US 6,431,917 B1
(45) Date of Patent: Aug. 13, 2002

(54) MODULAR TELEPHONE JACK

(75) Inventors: Yakov Belopolsky, Harrisburg; Lee W. Potteiger, Lewisberry, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/230,368

(22) PCT Filed: Jul. 25, 1997

(86) PCT No.: PCT/US97/13238

§ 371 (c)(1),
(2), (4) Date: Feb. 2, 2000

(87) PCT Pub. No.: WO98/05100

PCT Pub. Date: Feb. 5, 1998

Related U.S. Application Data

(60) Provisional application No. 60/022,712, filed on Jul. 26, 1996.

(51) Int. Cl.[7] ..... H01R 24/00

(52) U.S. Cl. ..... 439/676

(58) Field of Search ..... 439/676

(56) References Cited

U.S. PATENT DOCUMENTS

| | | | | |
|---|---|---|---|---|
| 3,369,214 A | | 2/1968 | Krumreich et al. | |
| 3,850,497 A | | 11/1974 | Krumreich et al. | |
| 4,050,769 A | | 9/1977 | Ammon | |
| 4,153,327 A | | 5/1979 | Johnson | |
| 4,193,654 A | | 3/1980 | Hughes et al. | |
| 4,210,376 A | | 7/1980 | Hughes et al. | |
| 4,292,736 A | | 10/1981 | Hughes et al. | |
| 4,296,991 A | | 10/1981 | Hughes et al. | |
| 4,556,264 A | | 12/1985 | Tanaka | |
| 4,629,266 A | | 12/1986 | Viselli | |
| 4,632,493 A | | 12/1986 | Matsuzaki et al. | |
| 4,648,678 A | | 3/1987 | Archer | |
| 4,688,875 A | * | 8/1987 | O'Connor | 439/676 |
| 4,734,043 A | | 3/1988 | Emert et al. | |
| 4,772,224 A | | 9/1988 | Talend | |
| 5,096,440 A | | 3/1992 | Katsumata | |
| 5,118,311 A | * | 6/1992 | Margini | 439/676 |
| 5,120,256 A | | 6/1992 | Walden | |
| 5,145,401 A | | 9/1992 | Archer | |
| 5,259,789 A | | 11/1993 | Patel et al. | |
| 5,318,464 A | | 6/1994 | DiMondi et al. | |
| 5,364,294 A | | 11/1994 | Hatch et al. | |
| 5,395,265 A | | 3/1995 | DiMondi et al. | |
| 5,419,720 A | | 5/1995 | Chen | |
| 5,456,619 A | | 10/1995 | Belopolsky et al. | |
| 5,538,448 A | | 7/1996 | Tsao | |
| 6,093,060 A | * | 7/2000 | Wiebking et al. | 439/676 |

FOREIGN PATENT DOCUMENTS

| | | |
|---|---|---|
| AU | 339988 | 3/1973 |
| DE | 7134149 | 9/1971 |
| GB | 1 457 779 | 2/1974 |

OTHER PUBLICATIONS

Electronic Packaging Microelectronics and Interconnection Dictionary by Harper, Charles A. and Martin B. Miller, 1993.*

* cited by examiner

*Primary Examiner*—Brian Sircus
*Assistant Examiner*—Hae Moon Hyeon
(74) *Attorney, Agent, or Firm*—Woodcock Washburn LLP

(57) ABSTRACT

A modular jack which comprises an insulative housing (10) comprising a base wall (12) and a peripheral lateral wall (20) projecting from and base edge (22) adjacent the base wall (12) in generally normal relation from the base wall (12) to a terminal edge (24) and having a rear wall (26) and front wall (28) with the base wall (12) to form an interior cavity (46) and having an opening (34) between the rear wall (26) and the front wall (28). The jack also comprises a conductor (48) fixed to an outer side of the peripheral lateral wall (20) adjacent the base wall (12) and extending into the interior cavity (46).

25 Claims, 13 Drawing Sheets

MODULAR TELEPHONE JACK

This application claims the benefit of provisionsal application 60/022,712 filed Jul. 26, 1996.

BACKGROUND OF THE INVENTION

1. Field of the Invention

This application relates electrical connectors and more particularly to modular jacks for telephones.

2. Brief Description of Prior Developments

Federal Communication Commission (FCC) part 68 subpart F allows users to insert 6-position plug into 8-position jack. An additional interpretation states that after insertions of the 6-pos plug, the same jack should be able to accept 8-position plug and contact forces on all contacts should still be in excess of 100 gr (1 N), and yet an additional customer requirement is to provide the same contact architecture for product series that may include 8-pos keyed jacks, 6 and 4 position jacks, products intended for Surface Mount as well as through-hole mount applications.

Therefore, a need exists to provide low cost product that satisfies FCC interpretation and is suitable for TMT and SMT applications.

SUMMARY OF THE INVENTION

The present invention is a modular jack which includes an insulative housing comprising a base wall and a peripheral lateral wall projecting wall in generally normal relation from said base wall to form an interior cavity. A conductive means is fixed to the outer side of the peripheral lateral wall adjacent the base wall and extending through the opening in the lateral wall and extending into the interior cavity. Floating movement of the conductive means adjacent the opening in the peripheral wall is possible.

Also included within the present invention is a method for inserting the conductive means into the housing described above. The conductive means is first inserted through the opening in the lateral will so that it is in spaced parallel relation to the base ball with a first section extending into the interior cavity and a second section extending outwardly from the peripheral wall. The first section is then bent toward the base ball until it is in diagonal relation thereto. The second section is then bent toward the peripheral wall and fixed to its outer surface. Alternatively, instead of initially positioning the first section in parallel relation to the base wall, the first section may be diagonally inserted into the interior cavity after which the second section is bent in the same way as described as above.

BRIEF DESCRIPTION OF THE DRAWINGS

The modular telephone jack of this invention is further described with reference to the accompanying drawings in which.

DETAILED DESCRIPTION OF THE PREFERRED EMBODIMENTS

Figure 1:
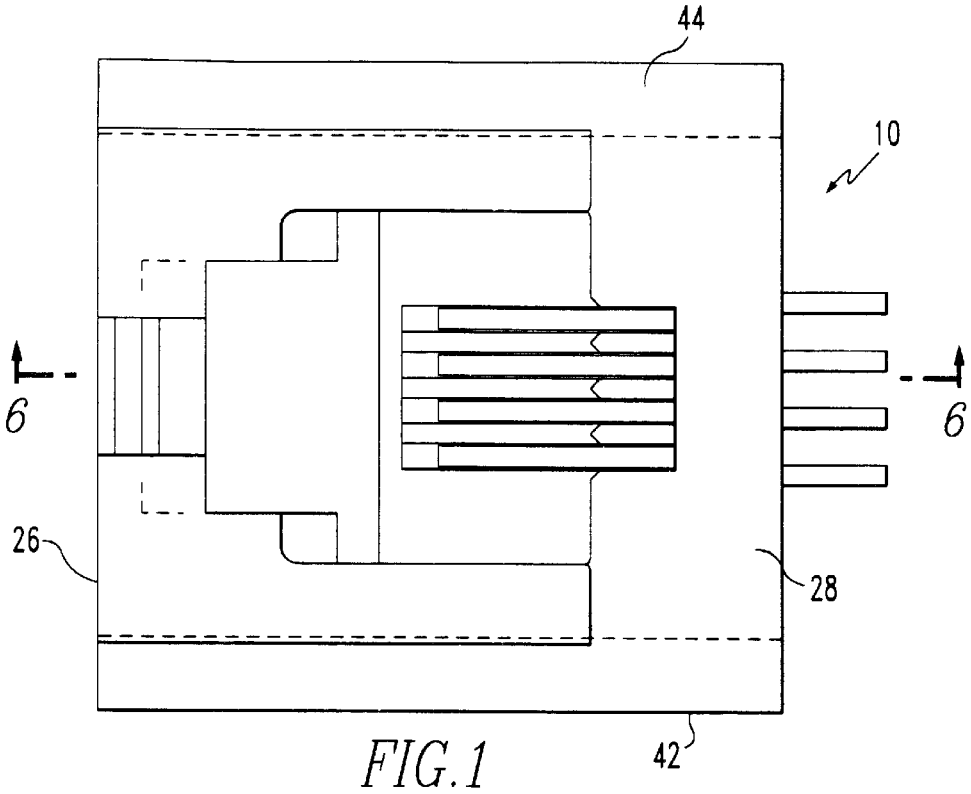
FIG. 1 is a top plan view of a preferred embodiment of the modular jack of the present invention.
Figure 2:
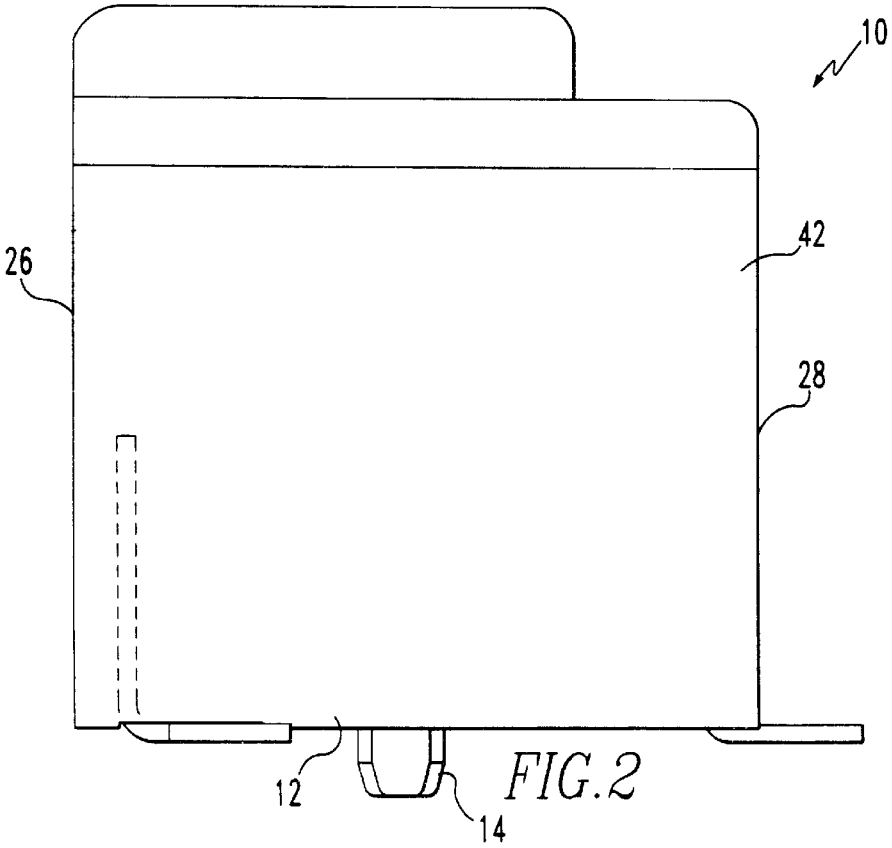
FIG. 2 is a side elevational view of the modular jack shown in FIG. 1.
Figure 3:
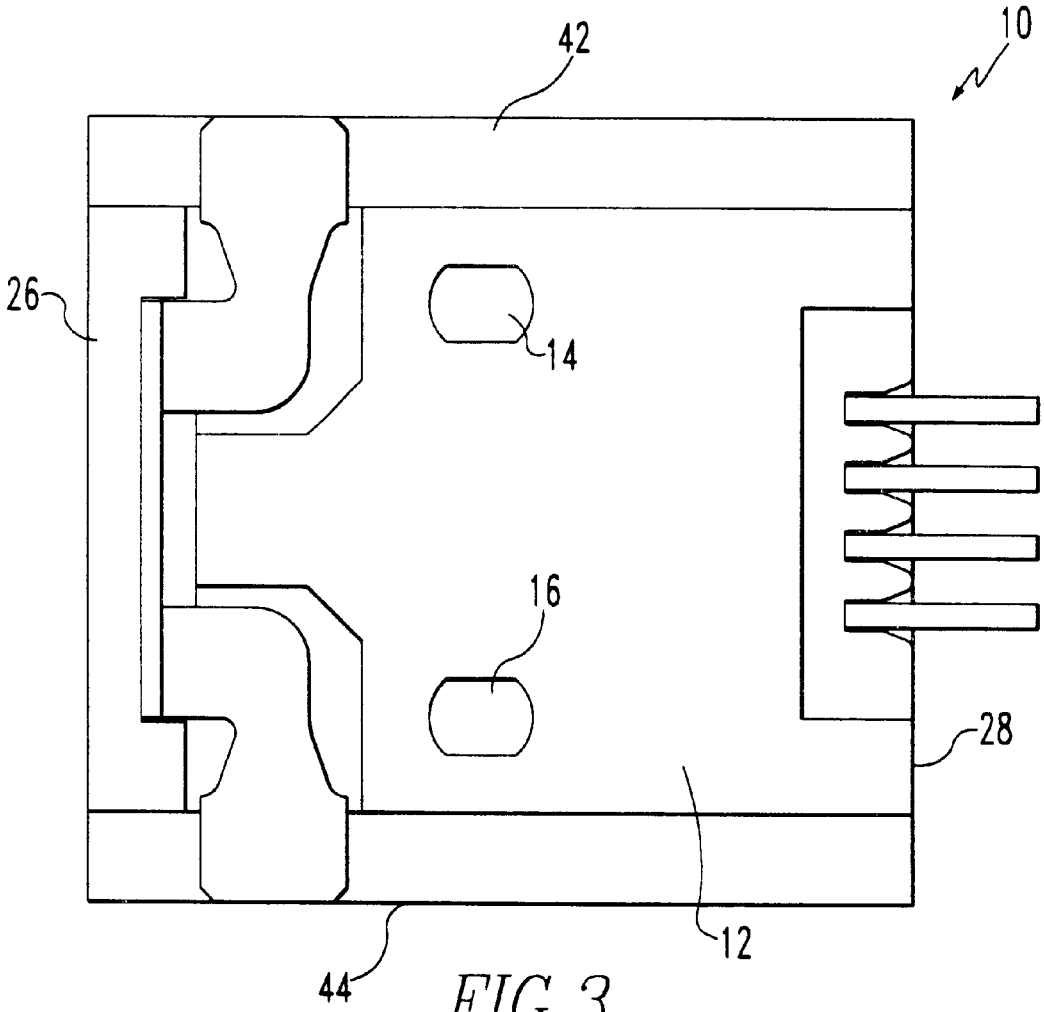
FIG. 3 is a bottom plan view of the modular jack shown in FIG. 1.
Figure 5:
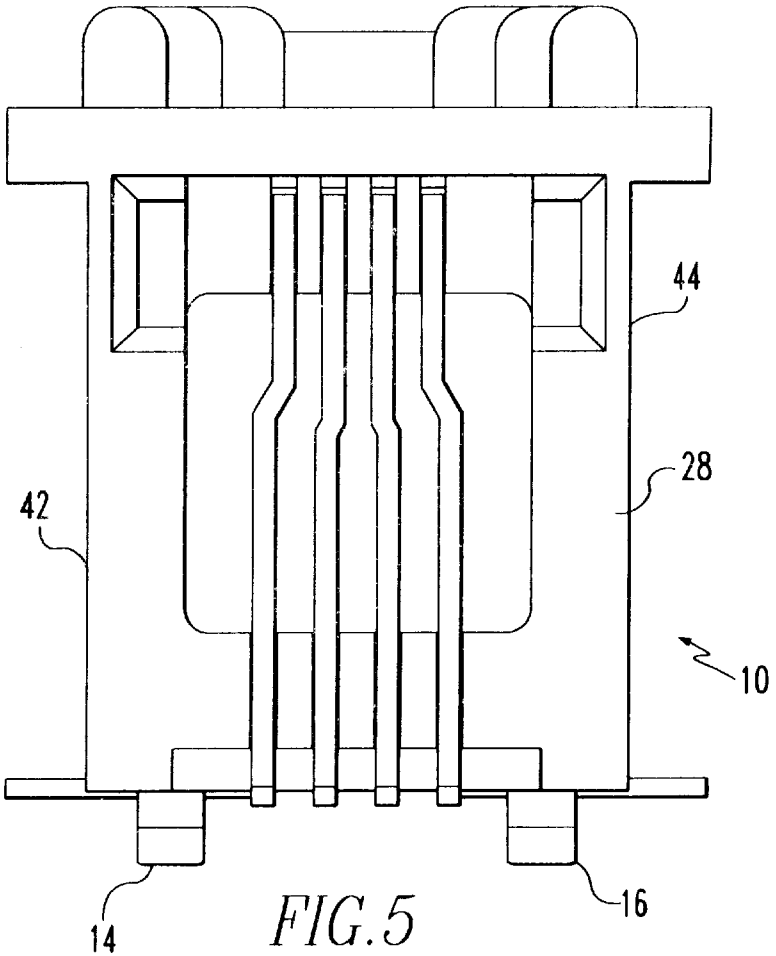
FIG. 5 is a front view of the modular jack shown in FIG. 1.
Figure 4:
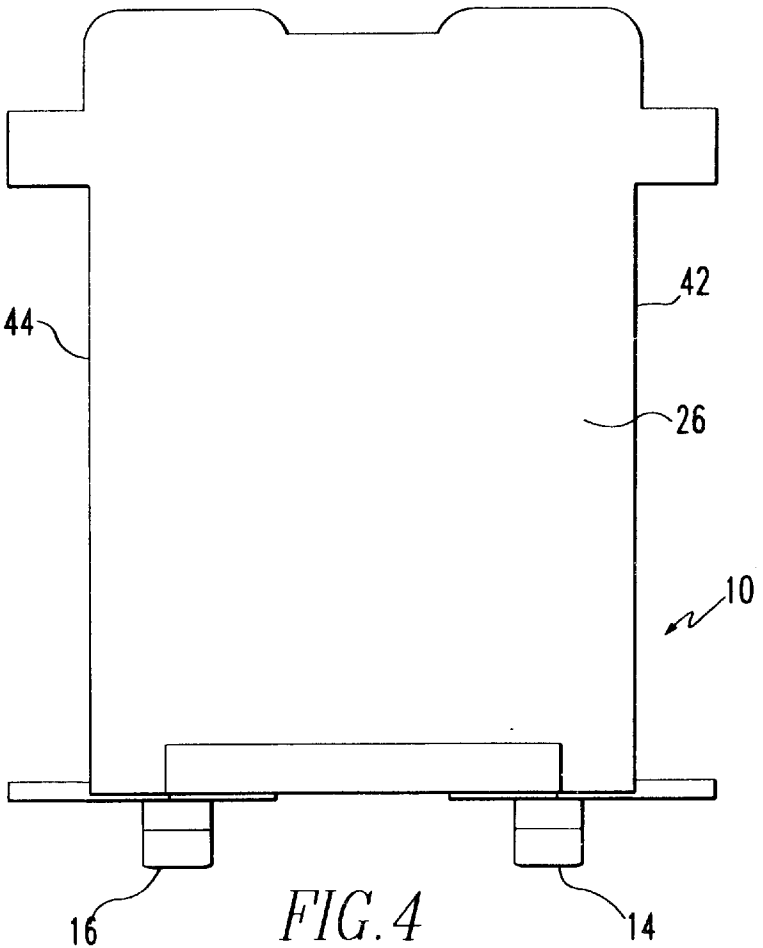
FIG. 4 is a rear view of the modular jack shown in FIG. 1.
Figure 6:
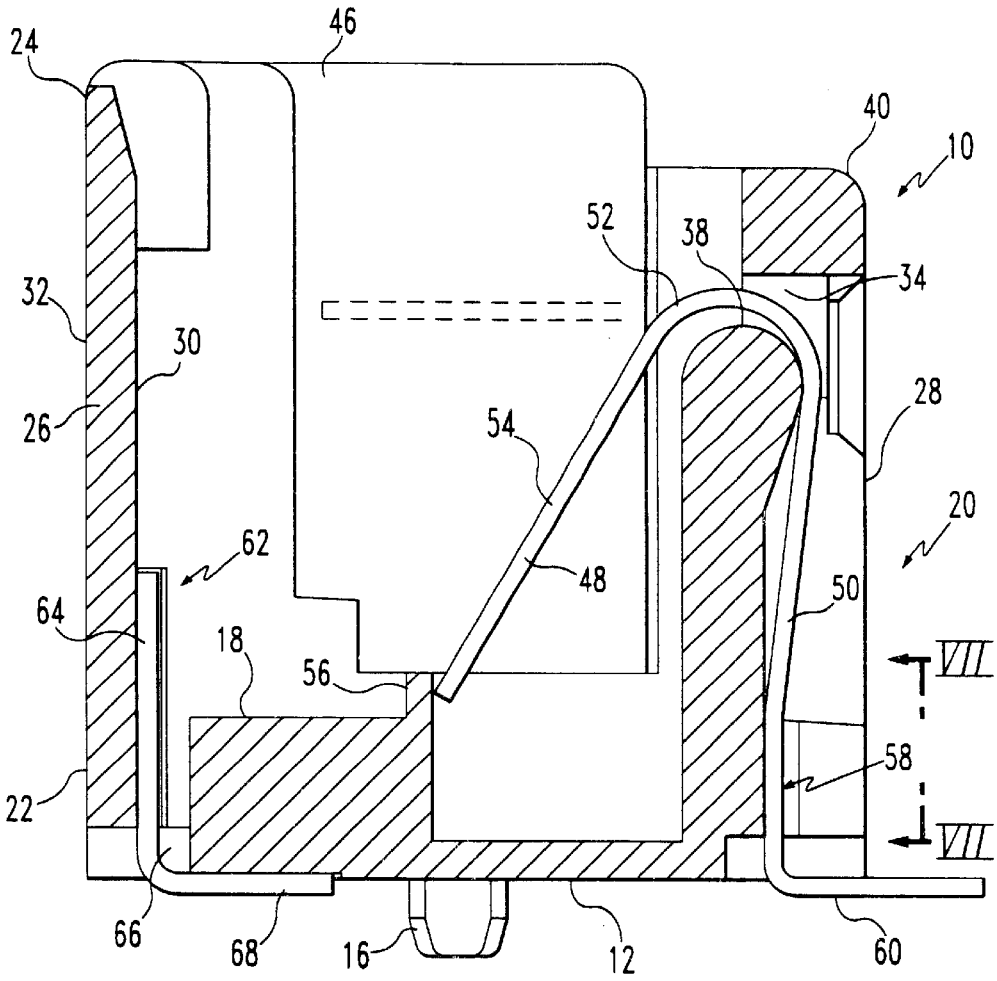
FIG. 6 is a cross sectional view through VI—VI in FIG. 1.
Figure 7:
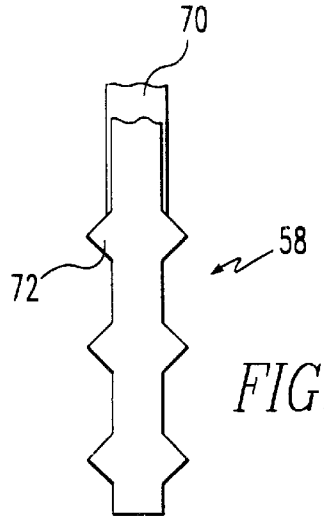
FIG. 7 is a detailed view from VII—VII in FIG. 6.
Figure 8:
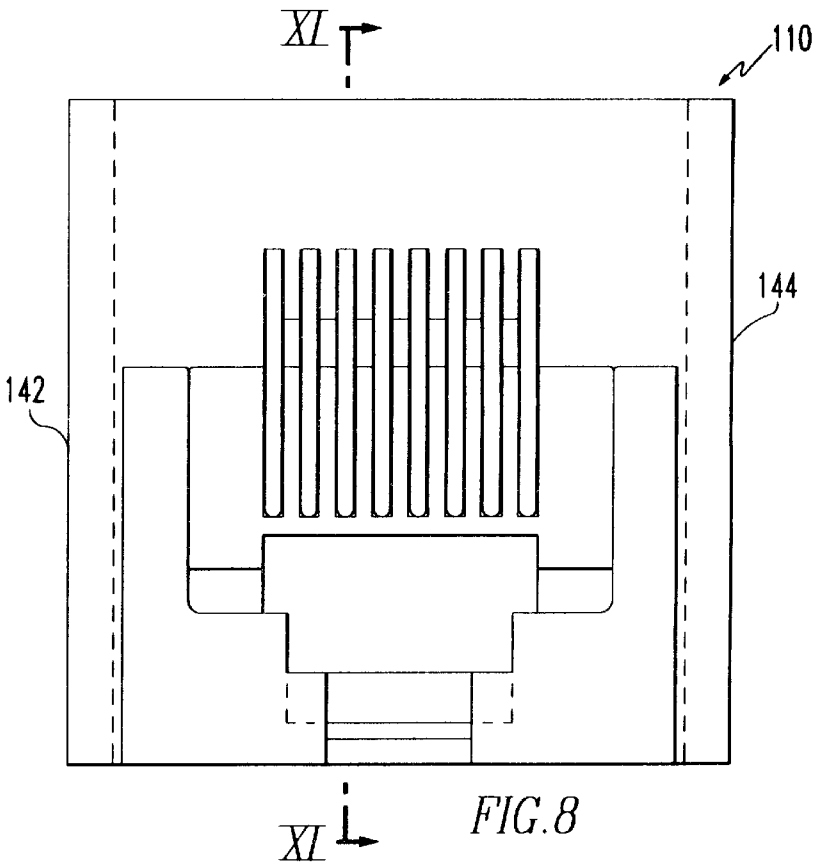
FIG. 8 is a front elevational view of a second embodiment of the modular jack of the present invention.
Figure 9:
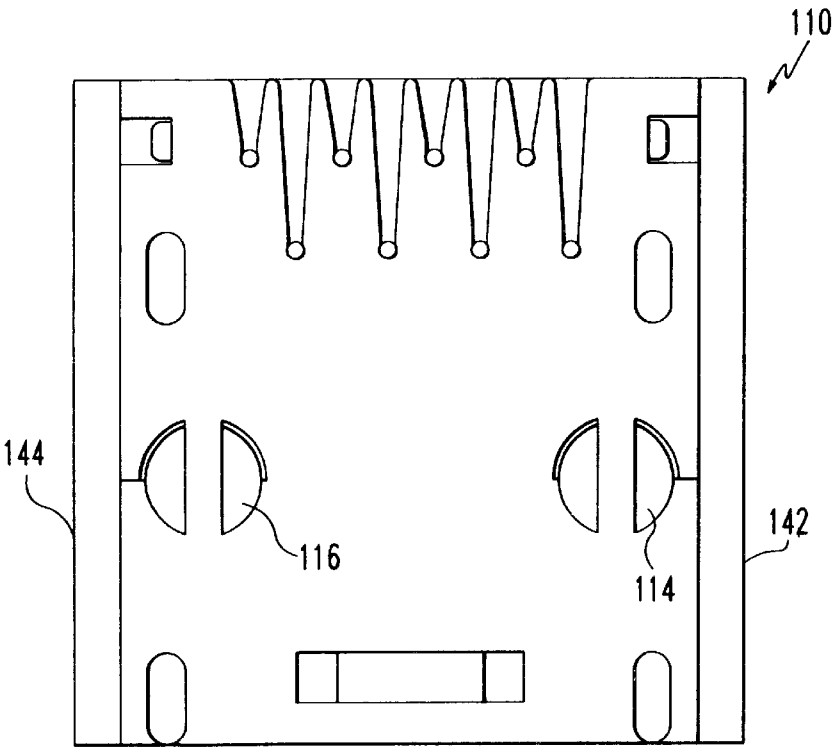
FIG. 9 is rear elevational view of the modular jack shown in FIG. 8.
Figure 10:
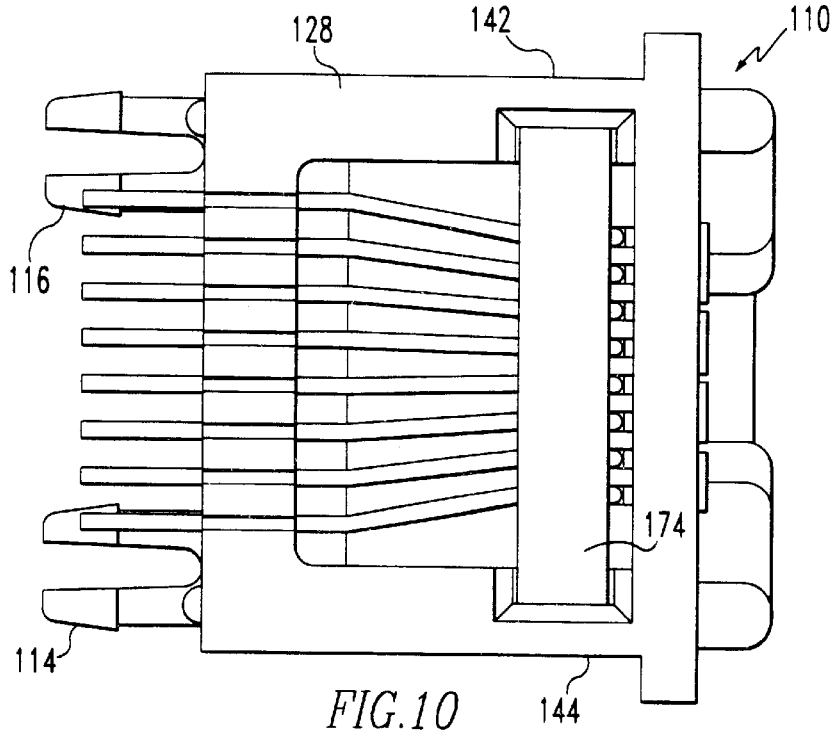
FIG. 10 is a top plan view of the modular jack shown in FIG. 8.
Figure 11:
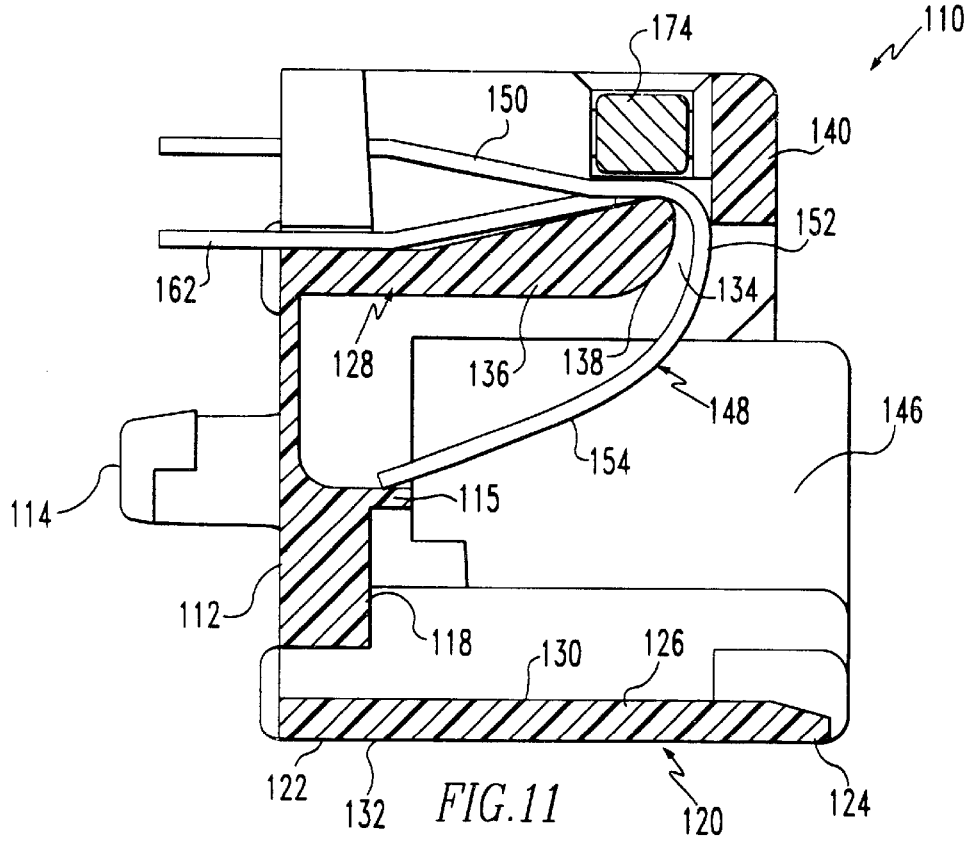
FIG. 11 is a cross sectional view through XI—XI in FIG. 8.
Figure 12:
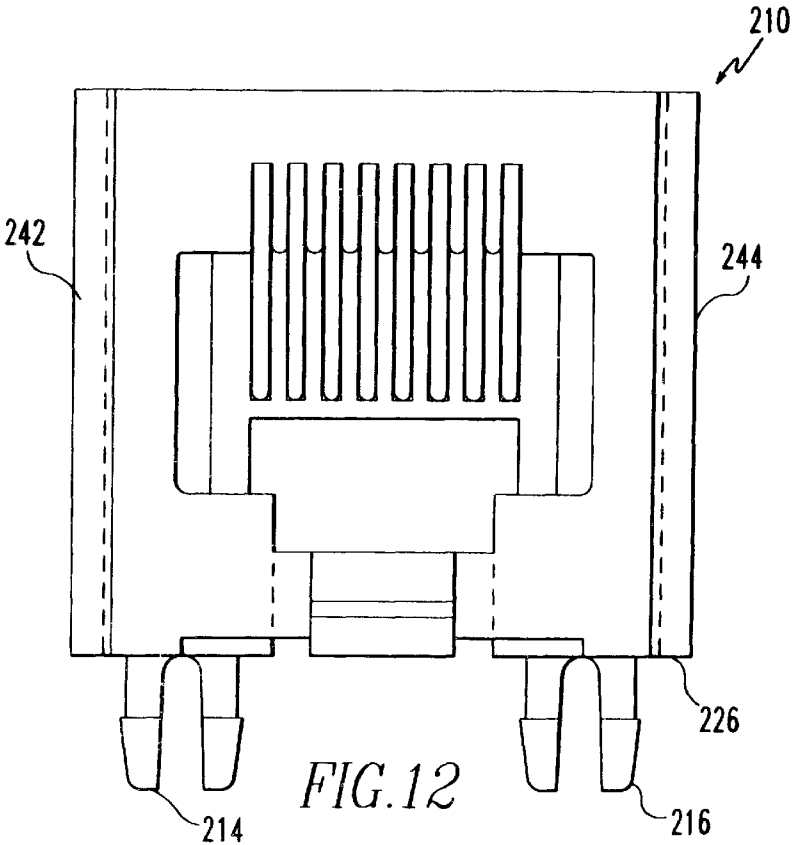
FIG. 12 is a front elevational view of a modular jack representing another preferred embodiment of the present invention.
Figure 13:
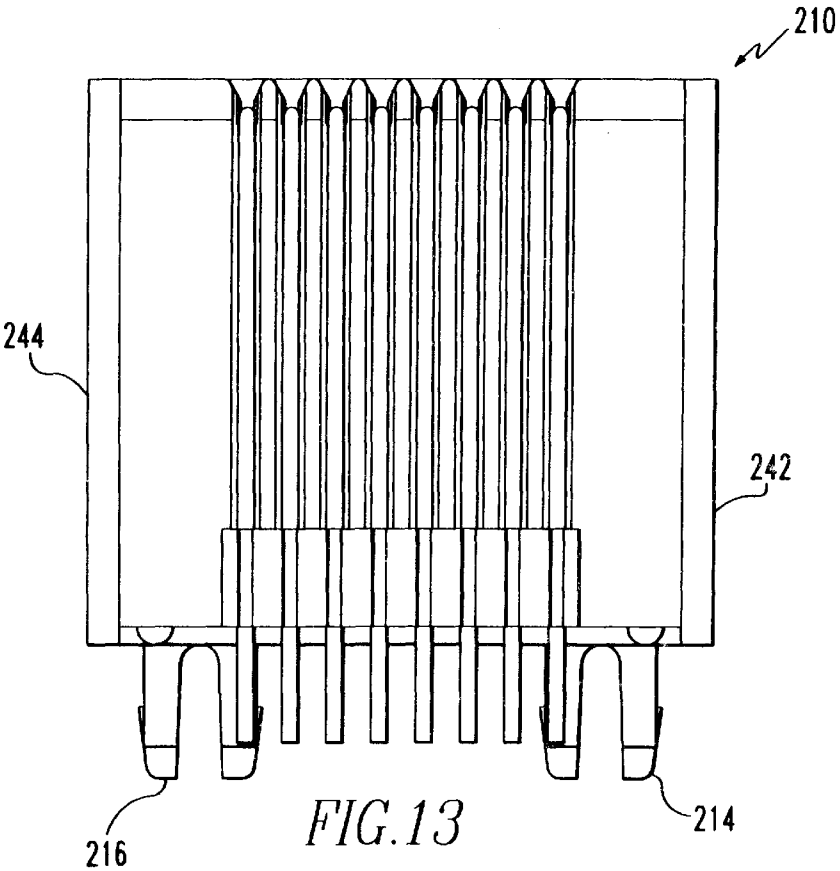
FIG. 13 is a rear elevational view of the modular jack shown in FIG. 12.
Figure 14:
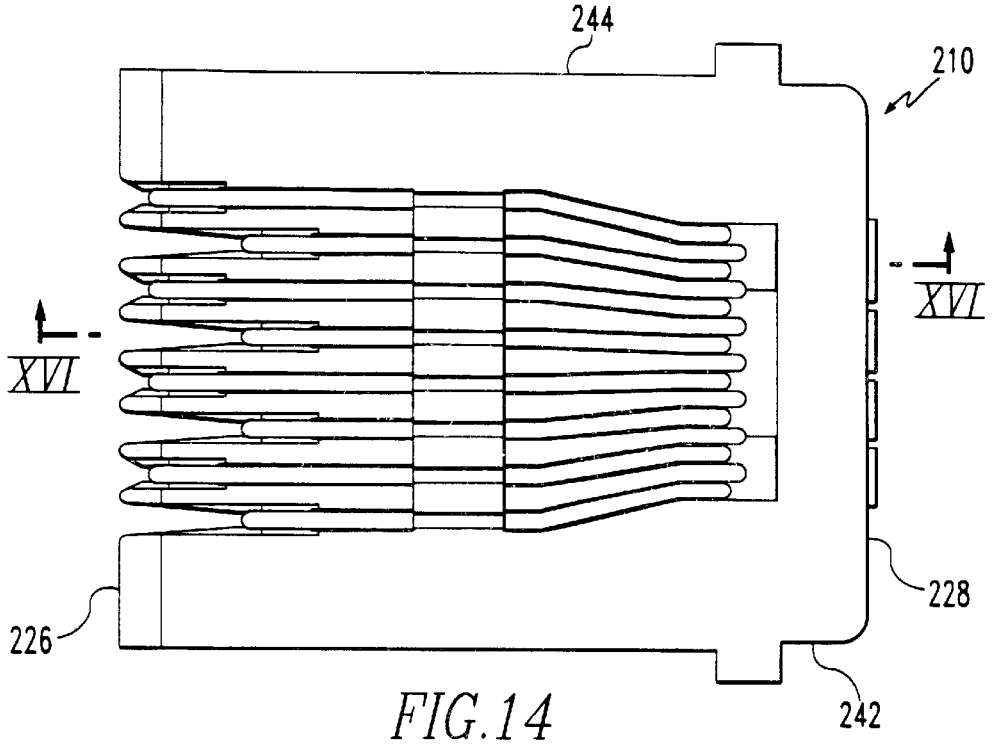
FIG. 14 is a top plan view of the modular jack shown in FIG. 12.
Figure 16:
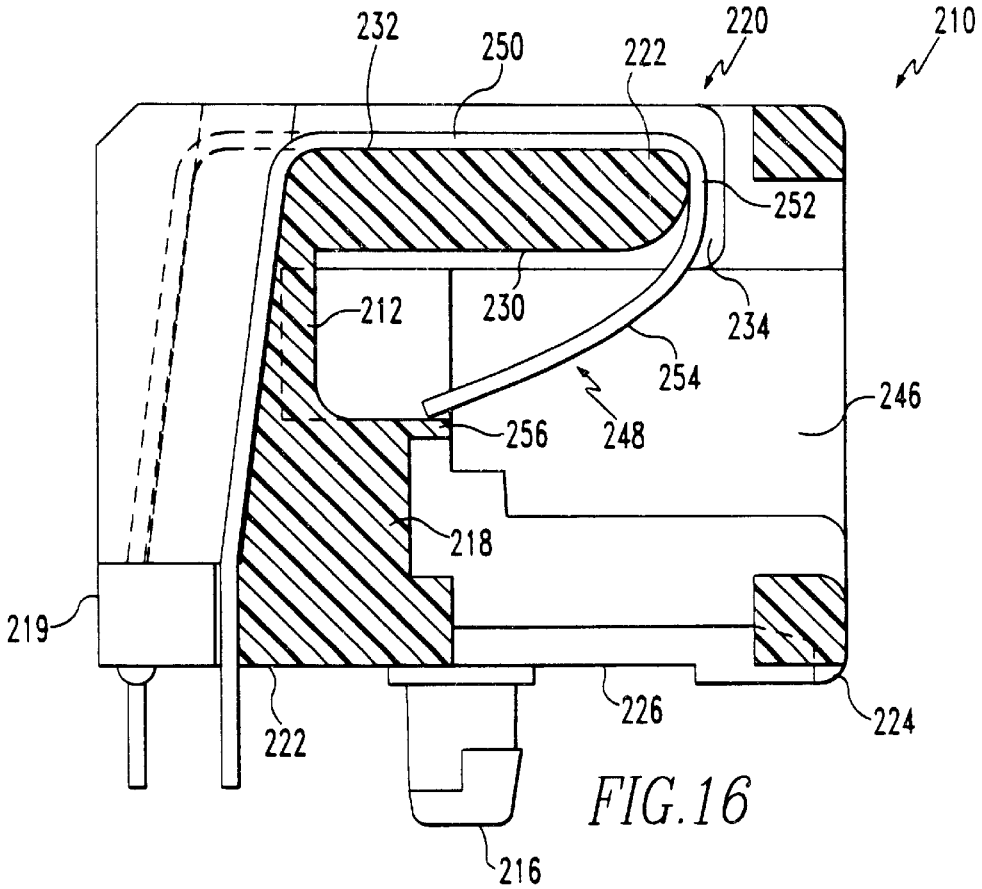
FIG. 16 is a cross sectional view through XVI—XVI in FIG. 14.
Figure 15:
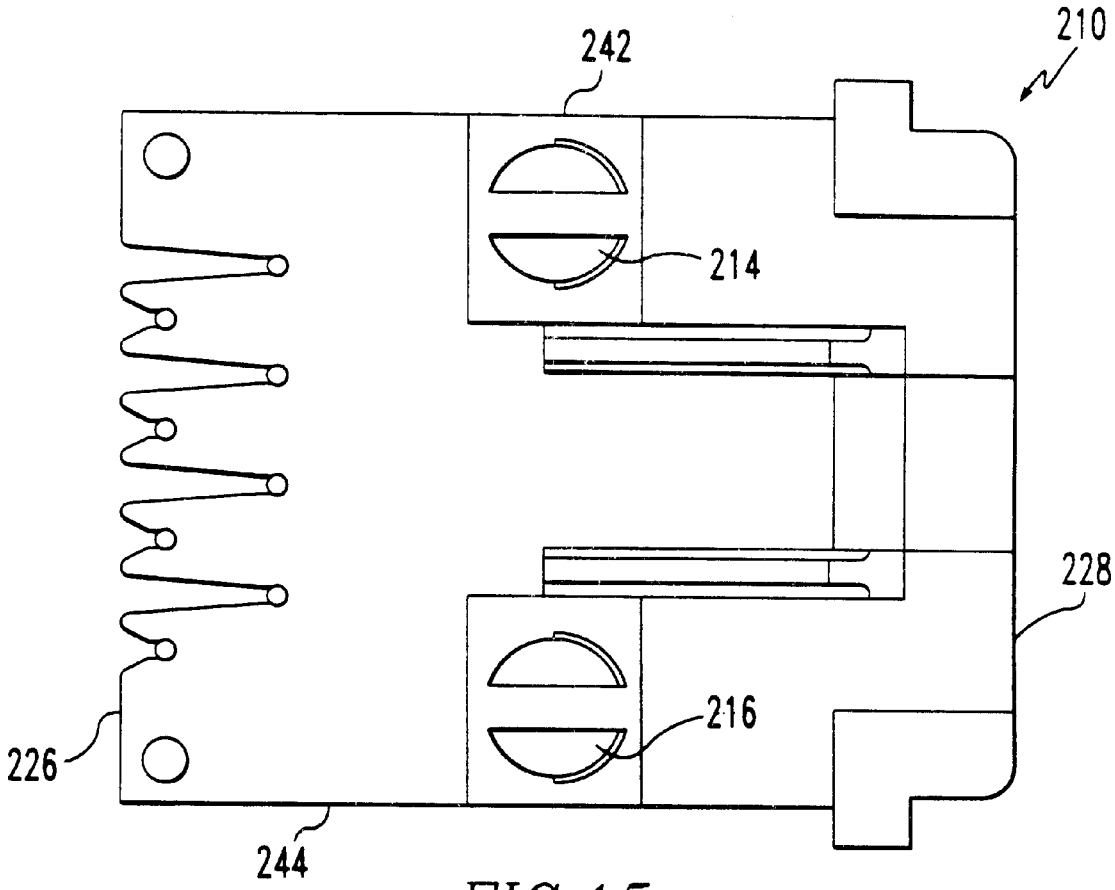
FIG. 15 is a bottom plan view of the modular jack shown in FIG. 12.

Referring to FIGS. 1–6, the modular jack includes an insulative housing shown generally at numeral 10 which may be comprised of a liquid polymer (LCP). The insulative housing includes a base wall shown generally at numeral 12 from which mounting pins 14 and 16 project downwardly. An upward projection 18 extends upwardly from the base wall 12. Also extending upwardly from the base wall 12 there is a peripheral wall shown generally at numeral 20. The peripheral wall extends upwardly from a lower base edge 22 to a terminal edge 24. The peripheral wall includes a rear wall 26 and a front wall 28. The peripheral wall has an inner side 30 and an outer side 32, and in the front wall 28 there is an opening 34 connecting the inner side and the outer side. Below this opening 34 the front wall includes a lower section 36 with a rounded top surface 38. Above the opening 34 front wall includes an upper section 40. The peripheral wall also includes intermediate walls 42 and 44 which extend in parallel relation between the rear wall 26 and front wall 28 to form an interior cavity 46. The modular jack also includes a plurality of conductive strips as at strip 48. This conductive strip includes a generally vertical section 50, an upper curved section 52 which passes through opening 34 and a diagonal section 54 which extends downwardly and laterally into interior cavity 46. At its terminal and a diagonal section engages 54 is supported by a ridge 56 which extends upwardly from projection 18. The conductive strip 48 is fixed to the front wall 28 by means of a barbed section 58. Horizontal section 60 which is adapted to be mounted on a printed circuit board (PCB) extends from the barbed section. Another conductive strip 62 which is made up of a vertical section 64 passes through an opening 66 in the base wall 62 and extends laterally in a horizontal section 68 to be adapted to be mounted on a PCB by SMT (i.e. Surface Mount Technology). Referring to FIG. 7, the barb section 58 engages a groove 70 by a plurality of barbs as at 72.

Referring to FIGS. 8–11, the modular jack includes an insulative housing shown generally at numeral 110 which may be comprised of a liquid polymer (LCP). The insulative housing includes a base wall shown generally at numeral 112 from which mounting pins 114 and 116 project downwardly. A lateral projection 118 extends laterally from the base wall 112. Also extending laterally from the base wall 112 there is a peripheral wall shown generally at numeral 120. The peripheral wall extends laterally from a lower base edge 122 to a terminal edge 124. The peripheral wall includes a bottom wall 126 and a top wall 128. The peripheral wall has an inner side 130 and an outer side 132, and in the front wall 128 there is an opening 134 connecting the inner side and the outer side. Below this opening 134 the front wall includes an inner section 136 with a rounded top surface 138. Above the opening 134 the front wall includes an outer section 140. The peripheral wall also includes intermediate walls 142 and 144 which extend in parallel relation between the bottom wall 126 and top wall 128 to form an interior cavity 146. The modular jack also includes a plurality of conductive wires as at wire 148. This wire includes a generally horizontal section 150, an outer curved section 152 which passes through opening 134 and a diagonal section 154 which extends downwardly and laterally into interior cavity 146. At its terminal, diagonal section 154 engages and is supported by a ridge 115 which extends laterally from projection 118. The wire 148 passes through a v-shaped section 149 in base wall 112 where it is adapted to be through mounted on a printed circuit board (PCB). Another wire 162 extends into the interior cavity and through the base wall to be adapted to be through mounted on a PCB. A strip 174 limits outward flexure of the wires as at wire 148.

Referring to FIGS. 12–16, another embodiment of the modular jack includes an insulative housing shown generally at numeral 210 which may be comprised of a liquid polymer (LCP). The insulative housing includes a base wall shown generally at numeral 212. A forward projection 218 and a rearward extension 219 extend from the base wall 212. Also extending in a forward direction from the base wall 212 there is a peripheral wall shown generally at numeral 220. The peripheral wall extends upwardly from a lower base edge 222 to a terminal edge 224. The peripheral includes a bottom wall 226 from which mounting pins 214 and 216 project downwardly and a top wall 228. The peripheral wall has an inner side 230 and an outer side 232, and in the front wall there is an opening 234 connecting the inner side and the outer side. The peripheral wall also includes intermediate walls 242 and 244 which extend in parallel relation between the bottom wall 226 and top wall 228 to form an interior cavity 246. The modular jack also includes a plurality of conductive wires as at wire 248. This conductive strip includes a generally horizontal section 250 parallel to the base wall, a generally vertical section parallel to the top wall, an upper curved section 252 which passes through opening 234 and a diagonal section 254 which extends downwardly and laterally into interior cavity 246. At its terminal and a diagonal section engages 254 is supported by a ridge 256 which extends upwardly from projection 218. The conductive wire 248 is retained in a v-shaped groove in the projection 219 of base wall 212. Vertical section is adapted to be through mounted on a printed circuit board (PCB). Another conductive wire 262 which includes a vertical section 264 passes through a v-shaped groove in projection 219 of the base wall 212.

Figure 17A:
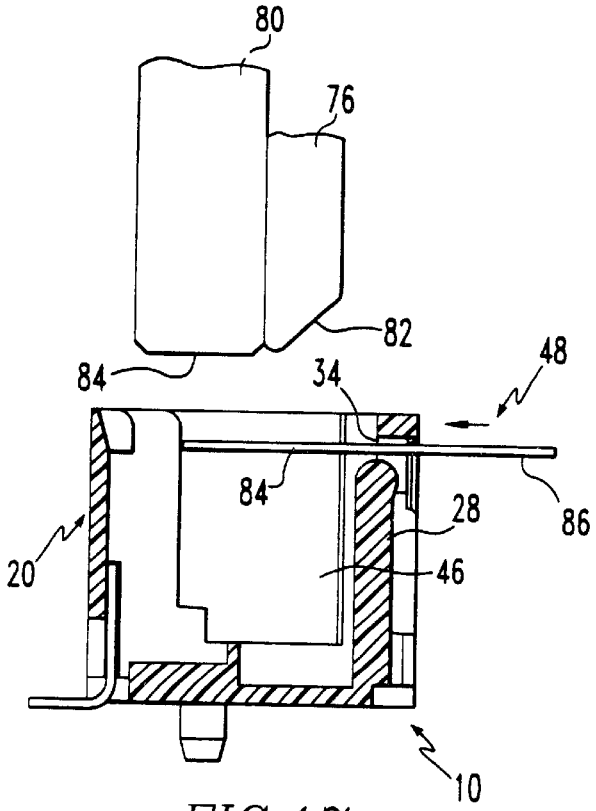
FIGS. 17*a*–17*g* are successive schematic views illustrating the preferred method of manufacturing the modular jack of the present invention.
Figure 17B:
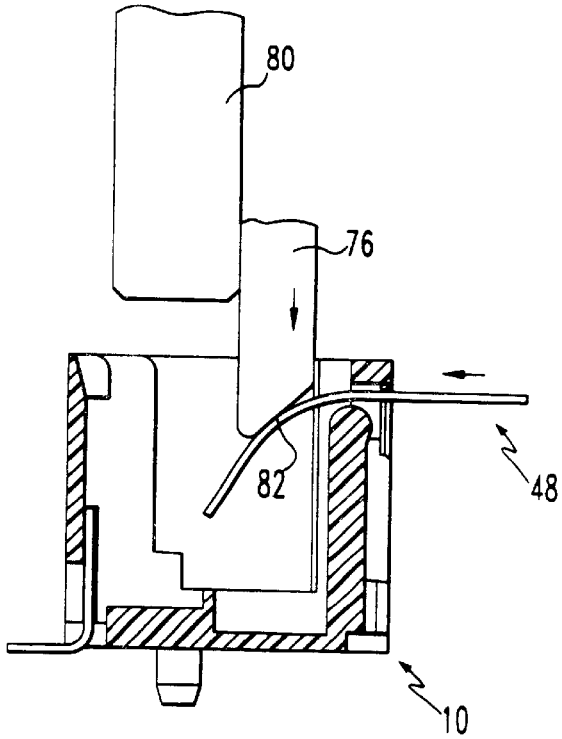
Figure 17C:
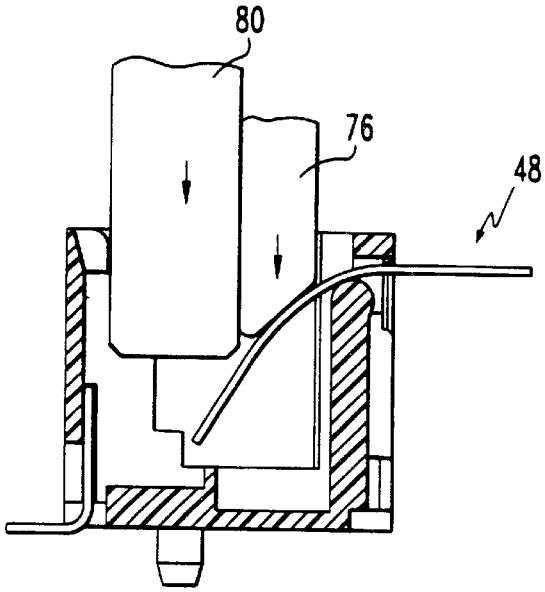
Figure 17D:
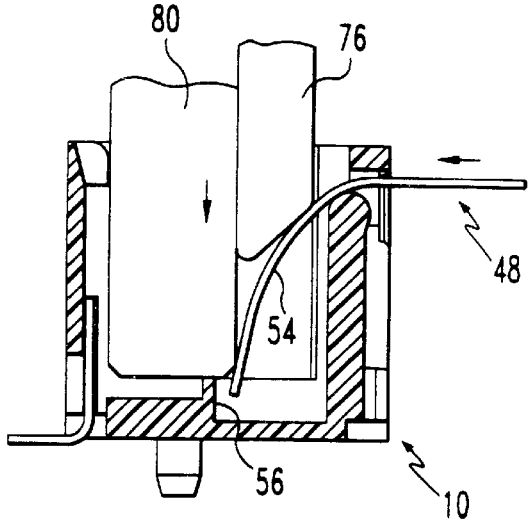
Figure 17E:
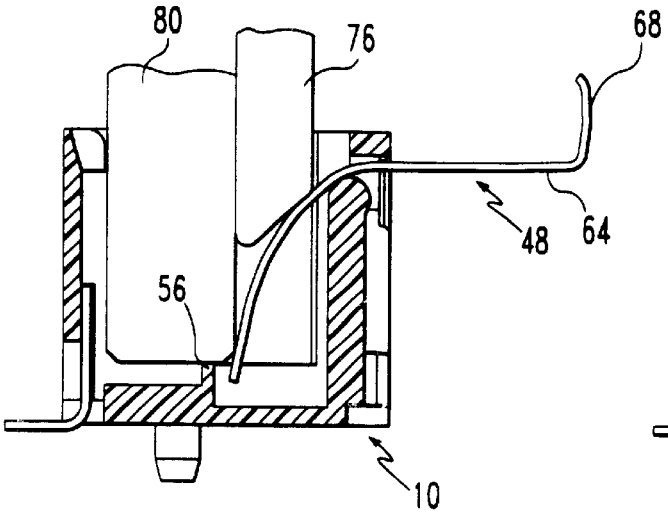
Figure 17F:
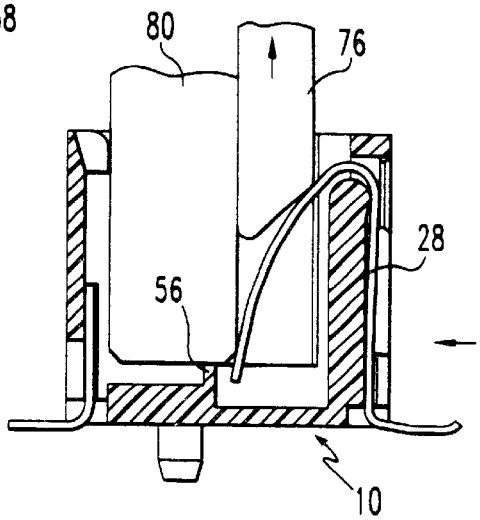
Figure 17G:
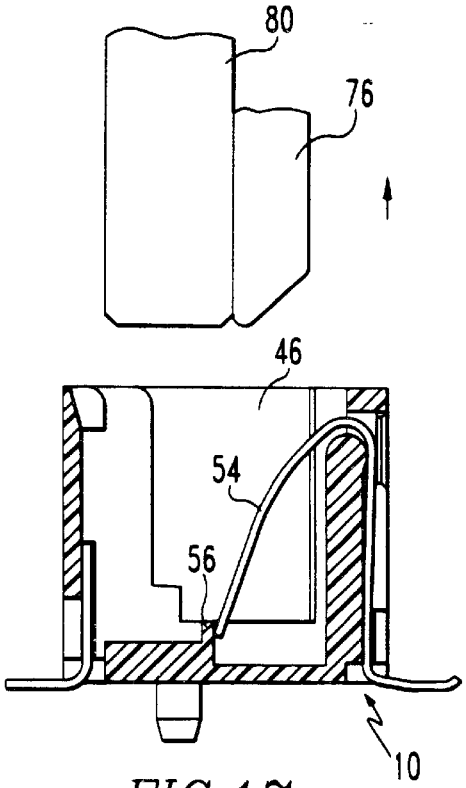

Referring to FIGS. 17*a*–17*g*, the preferred method of inserting the conductor in the modular jack is illustrated. Referring particularly to FIG. 17*a*, the insulative housing 10 which is comprised generally of the base wall 12 and the upwardly extending peripheral wall 20 is positioned beneath two plungers 76 and 80. Plunger 76 has a lower diagonal surface 78, and plunger 80 has a horizontal surface 82. These plungers are directly superimposed over the interior cavity 46 of the insulative housing 10. The conductive strip 48 is also inserted in the opening 34 of the front wall 28 section of the peripheral wall so that a first section 84 of the conductive strip is positioned in the cavity 46 in parallel relation to the base wall 12. A second section 86 of the conductive strip extends outwardly from the peripheral wall. Referring to FIG. 17*b*, plunger 76 is moved downwardly so that it's diagonal surface 78 bears against the conductive strip 48 in the cavity 46 and bends that conductive strip diagonally downwardly. Referring to FIG. 17*c*, the plunger 80 is then moved downwardly into the interior cavity 46. This motion continues until the plunger 80 engages the conductive strip 48 and bends that conductive strip past the ridge 56 on the upward projection 18 so that the diagonal section 54 of the conductive strip is formed as is shown in FIG. 17*d*. As is shown in FIG. 17*e*, the conductive strip is then bent at its outer end to form section 68 and 64. These sections are then bent downwardly and fixed to front wall 28 so as to form the curved section 52 as is shown in FIG. 17*f*. Finally, it is shown in FIG. 17*g* that after the barbed section 58 is fixed to the front wall 28, the plunger 76 and 80 are removed from the interior cavity 46 so that the diagonal section 54 of the conductive strip comes to rest on the ridge 56 to complete the insertion of the conductive strip.

Figure 18:
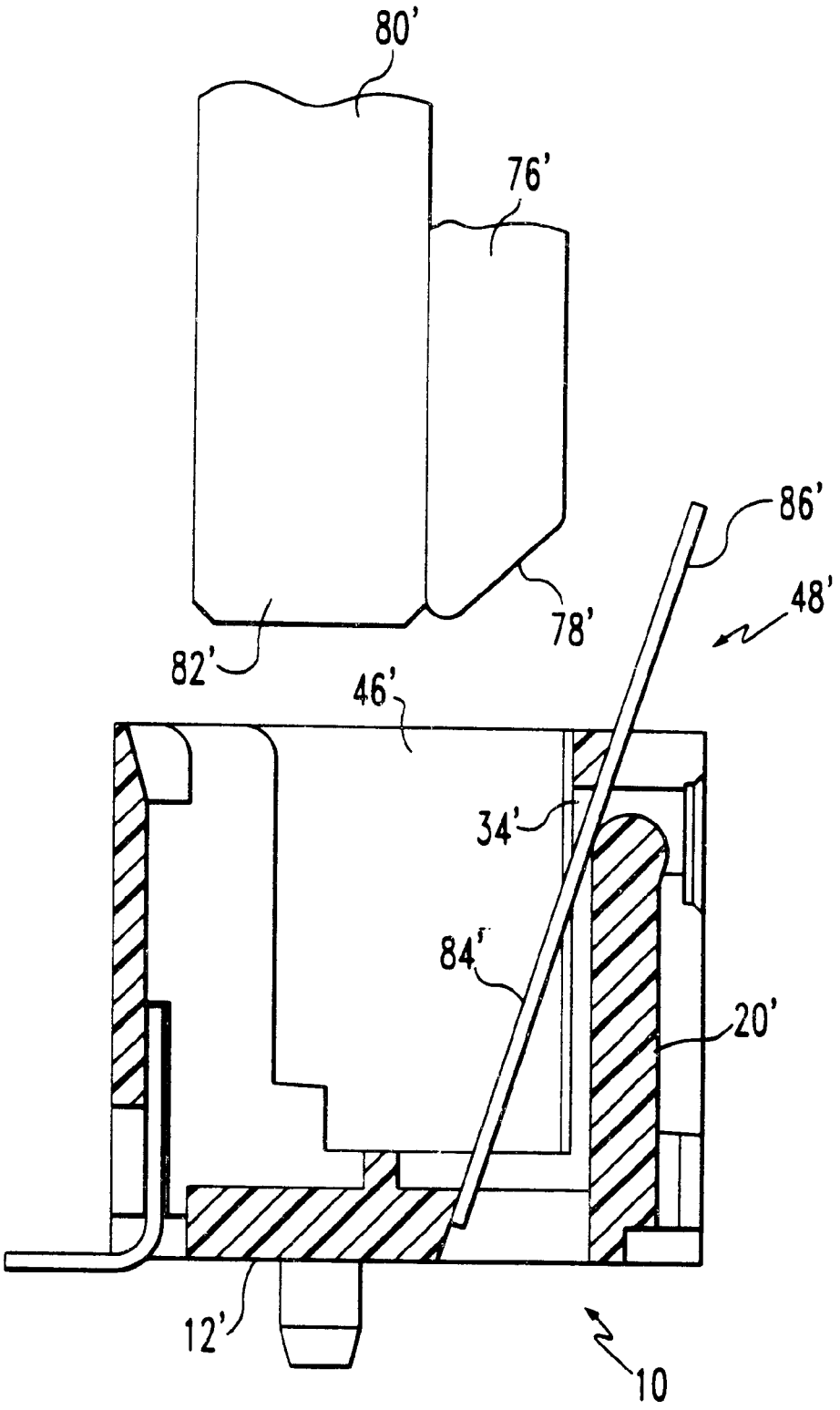
FIG. 18 is a schematic view illustrating an alternate preferred method of manufacturing the modular jack of the present invention.

Referring to FIG. 18, an alternate preferred method of inserting the conductor in the modular jack is illustrated. In this method, instead of performing the steps shown in FIGS. 17*a*–17*d*, the conductor 48' is inserted into the interior cavity 46' of the housing 10' through the opening 34' so that the first section 84' is diagonally oriented and resiliently biased against the base wall 12'. The second section extends outwardly from the peripheral wall 20' in diagonal relation to the base wall 12'. After the conductor has been positioned in this way, the plungers 76' having a diagonal surface 78 and 80' having a horizontal surface 82' are positioned in a manner similar to that shown in FIG. 17*e*. The second section 86' of the conductor is also bent and fixed to the lateral peripheral wall 20 in a way similar to the steps shown in FIGS. 17*e*–17*g*.

Figure 19A:
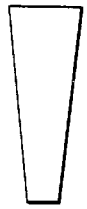
FIGS. 19*a* and 19*b* are schematic views illustrating a preferred method of using the modular jack of the present invention.
Figure 19B:
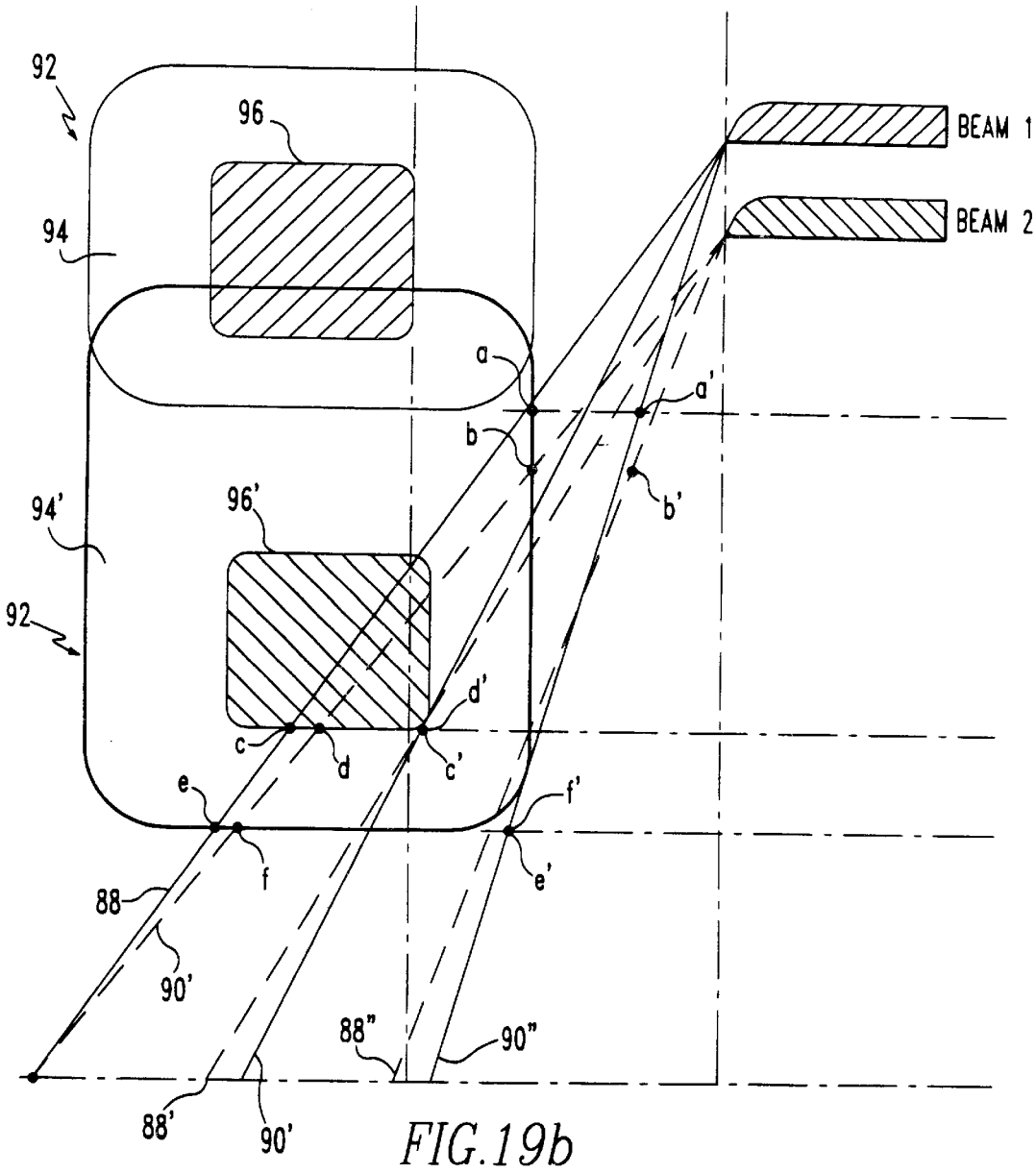

Referring to FIG. 19*a*, a top plan schematic view of a beam which may be used in modular jack of the present invention is shown. Although those skilled in the art will appreciate that ordinarily such beams will be of considerable longer length relative to the width shown. The end having the greater width will be that end which is fixed to the peripheral wall in the embodiments described above, and the end having the smaller width is that end which extends into the interior cavity of the housing. FIG. 19*b* schematically illustrates the flexions of two such trapezoidal beams (beam 1 and beam 2) which will demonstrate to those skilled in the art the advantages of such a trapezoidal beam construction. Beam 1 represents a longer beam which is shown at its original position at 88 and at successive deflective positions at 88' and 88". Beam 2 represents a shorter beam which is shown at its initial position at 90 and at successive deflective positions at 90' and 90". A plug is shown generally at numeral 92 wherein the plastic is shown at 94 and the metallic contact at 96. A successive position of said plug is shown at 92 and the successive positions of the plastic is at 94' and the metallic contact at 96'. Points a to a' show the initial deflection by the plastic section of the plug on beam when the plug is fully inserted. Points b to b' show deflection similar to points a to a on beam 2. Points c to c' show deflection by the contact on beam 1 when the plug is fully inserted. Points d to d' show deflection of beam 2 by the contact when the plug is fully inserted. Points e to e' show deflection of beam 1 near the end of that beam by the plastic when the plug is fully inserted, and points f to f' show a similar deflection on b2.

It will be appreciated that a modular jack has been described having floating conductive elements which are capable of deflection with little or no permanent deformation of those elements.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack comprising:

an insulative housing comprising a base wall and a peripheral lateral wall projecting from a base edge adjacent the base wall in generally normal relation from said base wall to a terminal edge and having an outer side and an inner side and forming with said base wall an interior cavity and having an opening between said outer and inner sides, the peripheral lateral wall including a bump between the base wall and the opening and adjacent the opening, the bump protruding away from the interior cavity and including an arcuate surface extending between the outer side and inner side past the opening; and a conductive element fixed to the outer side of the peripheral lateral wall at a fixing location adjacent the base wall and extending through the opening in the lateral wall and extending into the interior cavity, the conductive element being flush with a portion of the arcuate surface of the bump and being spaced from the outer side of the peripheral lateral wall by the bump at a portion of such outer side between the fixing location and the bump, the jack further comprising a conductive element supporting structure supporting the conductive element in the interior cavity, the conductive element supporting structure projecting into the interior cavity from the base wall.

2. The modular jack of claim 1 wherein the base wall is horizontal.

3. The modular jack of claim 1 wherein the base wall is vertical.

4. The modular jack of claim 1 wherein the conductive element is resiliently biased against the conductive element supporting structure.

5. The modular jack of claim 1 wherein the housing is a single integral unit.

6. The modular jack of claim 1 wherein the conductive element is a conductive strip.

7. The modular jack of claim 6 wherein the conductive means is fixed to the outer surface of the lateral peripheral wall.

8. The modular jack of claim 1 wherein the conductive element is a wire.

9. The modular jack of claim 8 through mounted on a printed circuit board (PCB).

10. The modular jack of claim 1 wherein a second conductive element extends into the interior cavity.

11. The modular jack of claim 10 wherein there is an opening in the base wall and said second conductive element extends through said opening in the base wall adjacent the lateral peripheral wall.

12. The modular jack of claim 11 wherein the second conductive element extends horizontally after passing through the opening in the base wall.

13. The modular jack of claim 10 wherein said second conductive element extends through the opening in the lateral peripheral wall and into the internal cavity of the insulative housing.

14. The modular jack of claim 1 wherein the conductive element is outwardly flexible adjacent the opening in the lateral wall.

15. The modular jack of claim 14 wherein means are provided to restrain outward flexure of the conductive element adjacent the opening in the lateral wall.

16. The modular jack of claim 1 wherein the conductive element is a trapezoidally shaped beam.

17. A method for inserting a conductive element in a modular jack comprising the steps of:

providing an insulative housing comprising a base wall and a peripheral lateral wall projecting from a base edge adjacent the base wall in generally normal relation from said base wall to a terminal edge and having an outer side and an inner side and forming with said base wall an interior cavity and having an opening between said outer and inner sides, the peripheral lateral wall including a bump between the base wall and the opening and adjacent the opening, the bump protruding away from the interior cavity and including an arcuate surface extending between the outer side and inner side past the opening, the insulative housing further comprising a conductive element supporting structure supporting the conductive element in the interior cavity wherein the conductive element supporting structure projects into the interior cavity from the base wall;

inserting an elongated conductive element through the opening in the peripheral lateral wall side such that a first section of the conductive element extends from the inner side of the peripheral lateral wall into the interior cavity of the insulative housing in parallel spaced relation to the base wall and such that a second section of the conductive element extends outwardly from the outer side of the lateral wall in parallel relation to the base wall;

bending the first section of the conductive element around the bump and toward the base wall until said first section is in diagonal relation to said base wall and in contact with the conductive element supporting structure; and bending the second section of the conductive element around the bump and toward the outer side of the peripheral lateral wall and fixing said second section of the conductive element to said outer side of the peripheral lateral wall at a fixing location adjacent the base wall such that the conductive element is flush with a portion of the arcuate surface of the bump and is spaced from the outer side of the peripheral lateral wall by the bump at a portion of such outer side between the fixing location and the bump.

18. A method for inserting a conductive element in a modular jack comprising the steps of:

providing an insulative housing comprising a base wall and a peripheral lateral wall projecting from a base edge adjacent the base wall in generally normal relation from said base wall to a terminal edge and having an outer side and an inner side and forming with said base wall an interior cavity and having an opening between said outer and inner sides, the peripheral lateral wall including a bump between the base wall and the opening and adjacent the opening, the bump protruding away from the interior cavity and including an arcuate surface extending between the outer side and inner side past the opening;

inserting an elongated conductive element through the opening in the peripheral lateral wall side such that a first section of the conductive element extends from the inner side of the peripheral lateral wall into the interior cavity of the insulative housing in diagonal relation to the base wall and such that a second section of the conductive element extends outwardly from the outer side of the lateral wall in diagonal relation to the base wall; and bending the second section of the conductive element around the bump and toward the outer side of the peripheral lateral wall and fixing said second section of the conductive element to said outer side of the peripheral lateral wall at a fixing location adjacent the base wall such that the conductive element is flush with a portion of the arcuate surface of the bump and is spaced from the outer side of the peripheral lateral wall by the bump at a portion of such outer side between the fixing location and the bump.

19. The modular jack according to claim 1 wherein the conducting element contacts the arcuate surface of the bump only on the outer side of the peripheral lateral wall when the conductive element is supported by said supporting structure.

20. The modular jack according to claim 1 wherein the peripheral lateral wall has a generally constant thickness between the bump and the base wall.

21. The method according to claim 17 comprising providing a peripheral lateral wall having a generally constant thickness between the bump and the base wall.

22. A connector, comprising:

an insulative housing comprising a base wall and peripheral lateral wall projecting there from;

said insulative housing enclosing an interior cavity;

said lateral wall having an outer surface and a bump protruding from the outer surface and having an arcuate surface spanning from said outer surface to said interior cavity; and a conductive element fixed to the peripheral lateral wall, extending flush with at least one linear portion of said outer surface, caused to become spaced from said outer wall by said bump, bent around said bump, and extending into the interior cavity; and a conductive element supporting structure supporting the conductive element in the interior cavity.

23. The connector according to claim 22, further comprising a conductive element supporting structure supporting the conductive element in the interior cavity, the conductive element supporting structure projecting into the interior cavity from the base wall.

24. A connector, comprising:

an insulative housing comprising a base wall and peripheral lateral wall projecting therefrom;

said insulative housing enclosing an interior cavity;

said lateral wall having an outer surface and a bump protruding from the outer surface and having an arcuate surface spanning from said outer surface to said interior cavity;

a conductive element fixed to the peripheral lateral wall, spanning at least one linear portion of said outer surface, bent around said bump, and extending into the interior cavity; and a conductive element supporting structure supporting the conductive element in the interior cavity;

said conductive element having at least two degrees of freedom of movement within said interior cavity.

25. A connector, comprising:

an insulative housing comprising a base wall and peripheral lateral wall projecting therefrom;

said insulative housing enclosing an interior cavity;

said lateral wall having an outer surface and a bump protruding from the outer surface and having an arcuate surface spanning from said outer wall to said interior cavity;

a conductive element fixed to the peripheral lateral wall, spanning at least one linear portion of said outer surface, bent around and at least partially spaced from said bump, and extending into the interior cavity; and a conductive element supporting structure supporting the conductive element in the interior cavity;

wherein as said conductive element is deflected inside said interior cavity all points on said conductive element move on a linear path.

* * * * *